United States Patent [19]

Fairchild et al.

[11] Patent Number: 4,696,618

[45] Date of Patent: Sep. 29, 1987

[54] HIGH TEMPERATURE SEAL AND TURBINE MOUNT

[75] Inventors: Jeffery Fairchild; Steven A. Heitz; John Symington, all of Rockford, Ill.

[73] Assignee: Sundstrand Corporation, Rockford, Ill.

[21] Appl. No.: 788,625

[22] Filed: Oct. 17, 1985

[51] Int. Cl.[4] ..... F01K 1/06

[52] U.S. Cl. ..... 415/119; 415/135; 415/219 C; 60/39.31; 60/39.32; 60/669; 285/224

[58] Field of Search ..... 415/119, 134, 135, 139, 415/219 C; 60/39.31, 39.32, 39.511, 669; 285/223, 224

[56] References Cited

U.S. PATENT DOCUMENTS

| | | | |
|---|---|---|---|
| 1,889,554 | 11/1932 | Kennedy | 415/219 R |
| 2,622,789 | 12/1952 | Lundquist | 415/135 X |
| 2,680,346 | 6/1954 | Michael | 60/39.32 |
| 3,131,642 | 5/1962 | Geer et al. | 415/219 C X |
| 3,151,894 | 10/1964 | Wilson et al. | 285/224 X |
| 3,184,917 | 5/1965 | Caouette et al. | 239/265.33 |
| 3,313,517 | 4/1967 | Hanschke et al. | 415/119 X |
| 3,371,482 | 3/1968 | Camboulives et al. | 60/39.32 |
| 3,455,073 | 7/1969 | Kiekahaefer | 52/200 |
| 3,591,963 | 7/1971 | Koop | 60/39.31 |
| 3,721,460 | 3/1973 | Holman et al. | 285/175 |
| 3,939,651 | 2/1976 | Penny | 285/224 X |
| 3,991,560 | 11/1976 | DeCorso et al. | 60/39.32 |
| 4,361,296 | 11/1982 | Hall et al. | 60/39.31 |
| 4,487,014 | 12/1984 | Vinciguerra | 60/39.31 |

FOREIGN PATENT DOCUMENTS

| | | | |
|---|---|---|---|
| 136485 | 2/1950 | Australia | 415/219 C |
| 1441257 | 6/1976 | United Kingdom | 415/134 |

*Primary Examiner*—Abraham Hershkovitz
*Assistant Examiner*—J. M. Pitko
*Attorney, Agent, or Firm*—Wood, Dalton, Phillips, Mason & Rowe

[57] ABSTRACT

The outlet 38 of a turbine housing 18 may be sealed to a port 46 while at the same time mounting a turbine 10 and associated transmission 36 for vibration and shock isolation by locating elastomeric seal and turbine mounts 50, 52 on opposed walls 28 and 30 of the turbine housing 18 defining the outlet 38.

8 Claims, 3 Drawing Figures

HIGH TEMPERATURE SEAL AND TURBINE MOUNT

FIELD OF THE INVENTION

This invention relates to steam turbine systems, and more particularly, to an elastomeric structure that may be used for the dual purpose of sealing a turbine exhaust duct to another structure while resiliently mounting the turbine for vibration and shock isolation.

BACKGROUND OF THE INVENTION

Various systems have been utilized to provide propulsion for torpedoes. Desirably, such systems should be quiet in operation to prevent or minimize the possibility of premature detection. Further, the system should not be depth sensitive, that is, should be capable of operating in a single, specified fashion whether located just below the surface or substantially below the surface.

Many systems that have been proposed, particularly those utilizing steam turbines, have not met the above criteria. Typically, such systems are open cycle systems where spent or exhaust steam is vented from the torpedo during its operation. Such venting not only increases the noise level of operation, but renders the torpedo sensitive to the depth at which it is running since the back pressure resisting venting will vary proportionately to depth.

To avoid these difficulties, it has been proposed to provide a close cycle steam turbine system particularly suited as the source propulsion for torpedoes. As implied by the term "close cycle", the working fluid, namely water, after it exhausts from the turbine as steam, is condensed and subsequently evaporated to form additional steam for driving the turbine wheel. As a consequence, the working fluid flows throughout a closed path, eliminating any need for venting the same, in turn, eliminating the source of noise associated with venting as well as sensitivity to depth.

At the same time, a closed cycle requires that the turbine exhaust be sealed to a condenser in such a way that the sealed interface will accommodate substantial thermal growth due to the temperture differential between non-operating temperature and operating temperature. To provide such a seal, as well as other necessary components such as engine mounts for the turbine with a minimum number of components, and yet provide a desired degree of reliability in operation, is a considerable task; and the present invention is directed to accomplishing that task.

SUMMARY OF THE INVENTION

It is a principal object of the invention to provide a new and improved power plant including a turbine. More specifically, it is an object of the invention to provide such a power plant including a turbine which may be ideally suited for utilization in a closed cycle steam turbine system.

An exemplary embodiment of the invention achieves the foregoing objects in a power plant construction including a turbine wheel rotatable about an axis. A turbine housing surrounds the turbine wheel and has a radially directed, peripheral outlet including two axially spaced side walls. A tubular housing contains the turbine wheel as well as the turbine housing and includes a radially inwardly opening port aligned with the outlet from the turbine housing. Rings of elastomeric material are secured to respective ones of the side walls near the radially outer peripheries of the same and O-ring seals sealingly engage the tubular housing about the port and are sealed to the elastomeric rings.

In a highly preferred embodiment, the elastomeric rings are axially elongated and the O-rings are located remote from the walls defining the outlet. In a highly preferred embodiment, the elastomeric rings are cylindrical.

The invention contemplates that the elastomeric rings carry grooved rings facing the tubular housing and that the O-rings be carried by and disposed within the grooves of the grooved rings.

In one embodiment of the invention, axially extending struts interconnect the grooved rings at circumferentially spaced locations about the outlet.

In a highly preferred embodiment of the invention, the elastomeric rings are sleeves which in turn are mounted on the axially outer sides of the side walls. Axially inner sides of the side walls are provided with coolant orifices. Each coolant orifice is directed across the outlet of the turbine housing toward the sleeve and O-ring associated with the opposite one of the side walls.

Other objects and advantages will become apparent from the following specification taken in connection with the accompanying drawings.

DESCRIPTION OF THE PREFERRED EMBODIMENT

Figure 1:
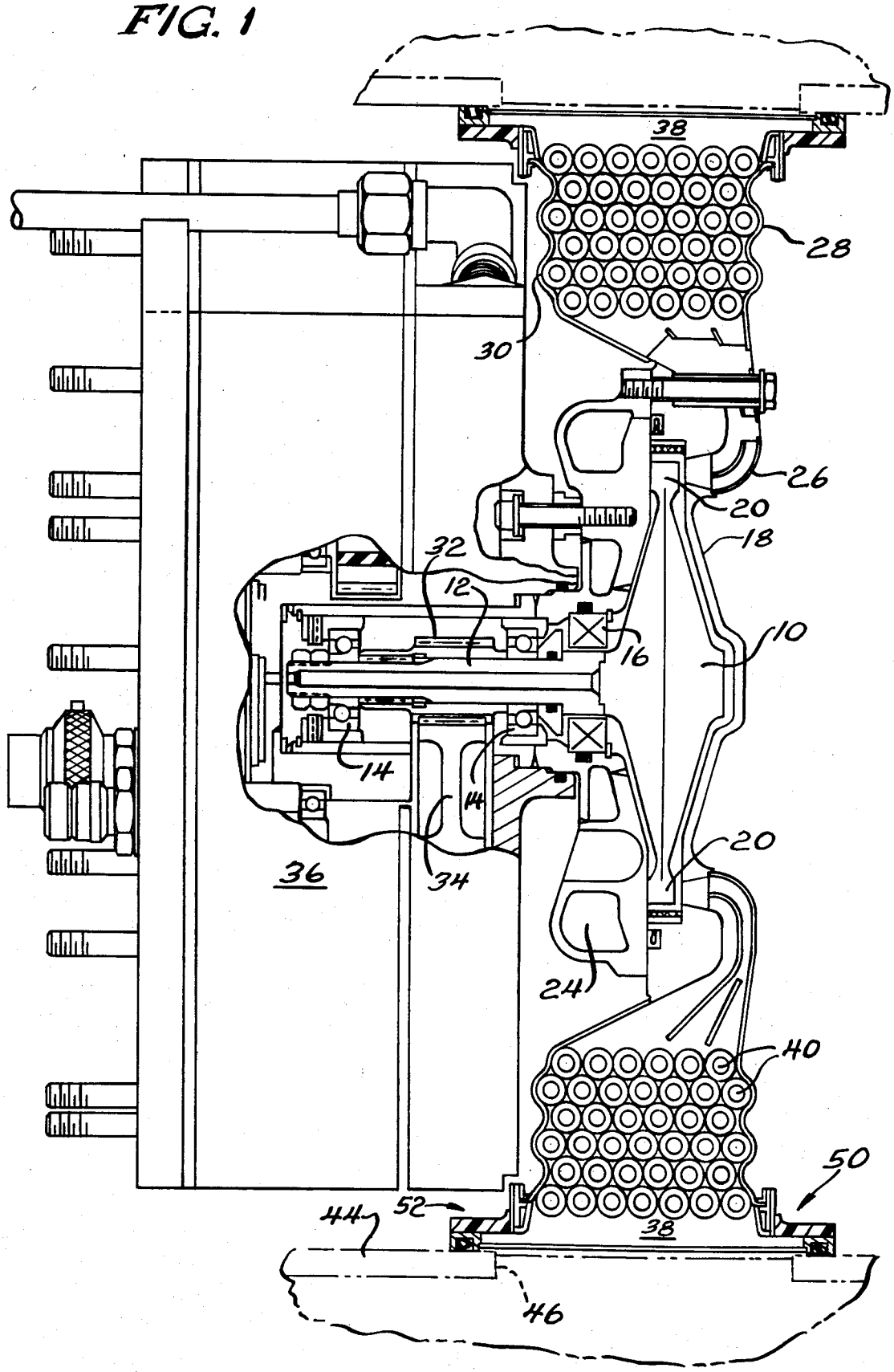
FIG. 1 is an elevational view of one embodiment of a power plant made according to the invention with parts broken away for clarity.

An exemplary embodiment of the invention is illustrated in the drawings and with reference to FIG. 1 is seen to include a turbine wheel 10 mounted on a shaft 12 journalled by bearings 14 and 16 within a turbine housing 18. Near its periphery, the turbine wheel 10 includes axial flow turbine blades 20 at which steam jets (not shown) from a steam manifold 24 are directed. Axially opposite of the manifold 24, is a baffle 26 which directs the exhaust flow from the turbine wheel 10 in the radially outward direction between two axially spaced walls 28 and 30.

The shaft 12 is splined to a gear 32 which in turn is engaged with a gear 34 forming the input to a transmission 36. When used as a power plant for the torpedo, the output (not shown) from the transmission 36 will ultimately drive propellers (not shown).

The radially outer location between the walls 28 and 30, shown at 38, defines an exhaust outlet from the turbine housing 18. Just radially inwardly of the outlet 38 is a series of finned tubes 40 which may serve as a regenerator as more fully disclosed in the commonly assigned, co-pending application of Symington, Ser. No. 768,735 now U.S. Pat. No. 4,637,215 entitled *Regenerator with Spray Cooler,* and executed on Aug. 12, 1985, the details of which are herein incorporated by reference.

In any event, the outlet 38 will be generally, radially outwardly opening and extend peripherally about the turbine wheel 10 (in some instances, the outlet 38 may not extend about a full 360° to accommodate other components of the system in which the power plant is used).

When used in environment of a torpedo, the various components heretofore described will be contained within a tubular housing 44. The housing 44 may include a port 46 that opens radially inwardly and which is aligned with the outlet 38. The port 46 may be in fluid communication with a so called "hull condenser" in which the exhaust steam from the turbine wheel 10 is condensed prior to being reevaporated to further drive the turbine wheel 10.

It is highly desirable to isolate vibration and shock from various components of the overall system. To this end, it is desirable to provide a vibration and shock isolating engine mount for the turbine wheel 10 and its housing 18 as well as the transmission 36. It is also necessary to seal the exhaust outlet 38 of the turbine housing 18 to the condenser port 46. The present invention accomplishes both functions with a single structure.

In particular, each of the walls 28 and 30 at its radially outer extremity, is provided with a seal and turbine mount structure, generally designated 50 and 52, respectively. Inasmuch as the mount 52 is a mirror image of the mount 50, only the mount 50 will be described.

Figure 2:
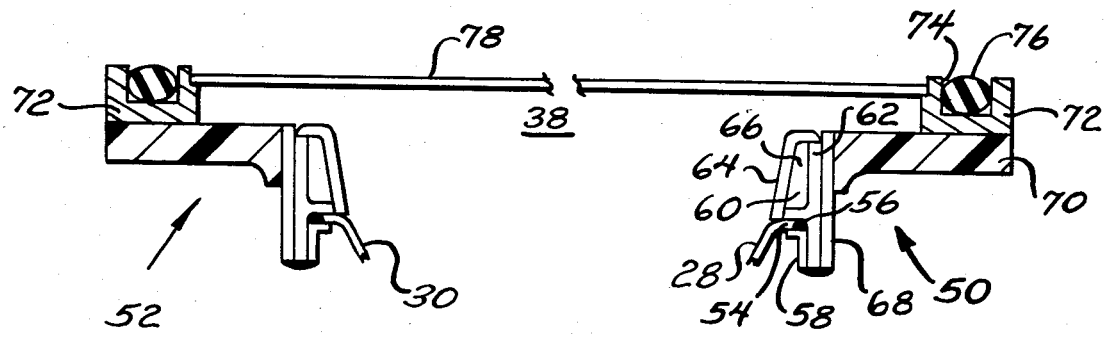
FIG. 2 is an enlarged, fragmentary, sectional view of a high temperature seal and turbine mount employed in the invention.
Figure 3:
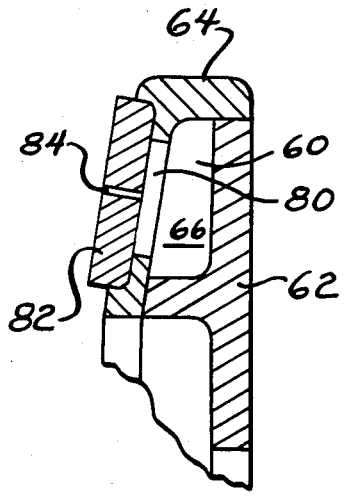
FIG. 3 is a further enlarged, fragmentary sectional view of a coolant orifice.

Referring to FIGS. 2 and 3, the side wall 28 terminates in a generally axially directed end 54 which is welded as at 56 in an annular slot defined by a radially inner, circular channel 58 and a radially outer, circular conduit 60. The conduit 60 is itself formed of a circular T-shaped element 62 to which a circular element 64 of L-shaped cross-section is welded or brazed to form an interior passage 66.

A generally planar ring-shaped plate 68 is welded or brazed to the elements 62 and 58 on the radial inner side thereof and at its radially outer extremity mounts an axially outwardly projecting, generally cylindrical sleeve 70. The sleeve 70 may be formed of Viton (TM) rubber or the like and is suitably bonded to the ring 68 so as to seal their interface.

At the axial end of the sleeve 70 remote from the plate 68, the same mounts a mounting ring 72 having a radially outwardly opening annular groove 74. Within the groove 74 is a high temperature O-ring 76 which, as seen in FIG. 1, sealing engages the tubular housing 44 on an associated side of the port 46.

The ring 72 is formed of stainless steel as are the elements 58, 62, 64 and 68, and is bonded to the elastomeric sleeve 70 in any conventional way such as to be sealed thereto.

Circumferentially about the outlet 38 of the turbine housing 18 may be a plurality of axially directed struts 78 being welded at opposite ends to respective ones of the rings 72.

As seen in FIG. 3, at periodic locations about its perimeter, the element 64 is provided with generally axially directed openings 80 (only one of which is shown). Each opening 80 is fitted with an orifice piece 82 having a central orifice 84 of the type adapted to generate a flat, fan-shaped spray. In a preferred embodiment, the arc of each fan-shaped spray will be approximately 60°, and the orifices 84 on each of the walls 28 and 30 are located on 60° centers with the orifices 84 on one of the walls being offset by 30° from the orifices on the other wall. As a consequence, virtually the entirety of the outlet 28 will be swept by the fluid emanating from the orifices 84.

As described more fully in the previously identified co-pending application of Symington, the fluid employed is preferably water which is utilized for the purpose of eliminating any superheat from the exhaust steam as it passes through the regenerator defined by the tubes 40. According to the present invention, such spray accomplishes the further function of providing a measure of cooling for the seal and mount structures 50 and 52. In this respect, it will be appreciated that the spray emanating from the orifices 84 on the wall 28 will be directed to impinge on the seal and turbine mount 52 while the spray from the orifices 84 on the wall 30 will impinge upon and cool the seal and turbine mount 50.

A seal and turbine mount according to the invention provides effective shock and vibration isolation for the turbine 10 and the transmission 36 in acting as a mount for the front end of such components, when other mounts (not shown) and being utilized for mounting the rearward end of the drive train. In addition, the structure serves to seal the outlet 36 to the port 46 to contain working fluid thereby ideally suiting the power plant for use in a closed cycle system. The specific configuration of component shown results in a mount of low stiffness which can accommodate substantial thermal growth as the temperature of the turbine and its housing 18 builds up to operating temperature from ambient temperature upon the initiation of operation.

What is claimed:

1. A power plant comprising a turbine wheel rotatable about an axis;

a transmission engaged with said turbine wheel;

a turbine housing surrounding said turbine wheel and having a radially directed peripheral outlet including two axially spaced side walls;

a tubular housing centered about said axis and containing said turbine wheel, said transmission, and said turbine housing and including a radially inwardly opening port aligned with said outlet;

a pair of elastomeric sleeves, one for each wall, mounted on and sealed to said walls near their radially outer extremities;

rings carried by and sealed to the radially outer side of each of said sleeves at an axial location remote from the corresponding wall;

each said ring having a radially outwardly opening groove flanking a side of said port; and an O-ring disposed in each said groove and sealingly engaging said tubular housing.

2. The power plant of claim 1 wherein said sleeves are mounted on the axially outer sides of said wall.

3. The power plant of claim 2 wherein the axially inner sides of said walls are provided with coolant orifices, each directed across said outlet toward the sleeve and O-ring associated with the opposite one of said walls.

4. The power plant of claim 1 wherein said sleeves are cylindrical.

5. A power plant comprising a turbine wheel rotatable about an axis;

a turbine housing surrounding said turbine wheel and having a radially directed, peripheral outlet including two axially spaced side walls;

a tubular housing containing said turbine wheel and said turbine housing and including a radially inwardly opening port aligned with said outlet;

rings of elastomeric material secured to respective ones of said walls near the radially outer peripheries thereof and about said axis; and O-ring seals sealingly engaging said tubular housing about said port and sealed to said elastomeric rings.

6. The power plant of claim 5 wherein said elastomeric rings are axially elongated and said O-rings are remote from said walls.

7. The power plant of claim 5 wherein said elastomeric rings carry grooved rings facing said tubular housing, and said O-rings are carried by said grooved rings.

8. The power plant of claim 7 wherein axially extending struts interconnect said grooved rings at circumferentially spaced locations.

* * * * *